US010724550B2

(12) United States Patent
Fletcher et al.

(10) Patent No.: US 10,724,550 B2
(45) **Date of Patent: *Jul. 28, 2020**

(54) VENTURI DEVICES WITH DUAL VENTURI FLOW PATHS

(71) Applicant: Dayco IP Holdings, LLC, Troy, MI (US)

(72) Inventors: David E. Fletcher, Flint, MI (US); Brian M. Graichen, Leonard, MI (US); James H. Miller, Ortonville, MI (US); Keith Hampton, Ann Arbor, MI (US)

(73) Assignee: Dayco IP Holdings, LLC, Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/865,595

(22) Filed: Jan. 9, 2018

(65) Prior Publication Data

US 2018/0128287 A1 May 10, 2018

Related U.S. Application Data

(63) Continuation of application No. 14/734,228, filed on Jun. 9, 2015, now Pat. No. 9,879,699.

(Continued)

(51) Int. Cl.

| | |
|---|---|
| ***F04F 5/14*** | (2006.01) |
| ***F04F 5/20*** | (2006.01) |
| ***F04F 5/54*** | (2006.01) |

(52) U.S. Cl.

CPC ..... *F04F 5/14* (2013.01); *F04F 5/20* (2013.01); *F04F 5/54* (2013.01)

(58) Field of Classification Search

CPC ..... F04F 5/14; F04F 5/20; F04F 5/54; F04F 5/42; Y10T 137/87587; Y10T 137/87643;

(Continued)

(56) References Cited

U.S. PATENT DOCUMENTS

| | | | |
|---|---|---|---|
| 1,845,969 | A | 2/1932 | Hueber |
| 3,140,324 | A | 7/1964 | Haase |

(Continued)

FOREIGN PATENT DOCUMENTS

| | | |
|---|---|---|
| DE | 4310761 | 10/1994 |
| EP | 2664849 A2 | 11/2013 |

(Continued)

OTHER PUBLICATIONS

EP, Supplementary European Search Report; Patent Application No. 14811266.7; 5 Pages (dated Apr. 5, 2017).

(Continued)

*Primary Examiner* — Michael R Reid

(74) *Attorney, Agent, or Firm* — FisherBroyles, LLP; Susan M. Oiler

(57) ABSTRACT

A Venturi device has a body defining a motive section and a discharge section converging toward and spaced a distance apart to define a Venturi gap, defining a first suction port and a second suction port each in fluid communication with the Venturi gap, and defining a chamber having an outlet end of the motive section and an inlet end of the discharge section dividing the chamber into a first portion and a second portion in fluid communication with one another above and below the inlet and outlet ends and through the Venturi gap. The first and second portions both have a plurality of spaced apart fingers protruding radially and axially from an inner wall thereof. A suction housing is sealingly connected to the chamber and collectively defines a check valve with the body, and a cap is sealing connected to close another end of the chamber.

14 Claims, 10 Drawing Sheets

Related U.S. Application Data

(60) Provisional application No. 62/009,655, filed on Jun. 9, 2014.

(58) Field of Classification Search
CPC ..... Y10T 137/87595; Y10T 137/87603; Y10T 137/87611; Y10T 137/87619; Y10T 137/87627; Y10T 137/87635
USPC ..... 137/888, 895, 889, 890, 891, 892, 893, 137/894
See application file for complete search history.

(56) References Cited

U.S. PATENT DOCUMENTS

| | | | | |
|---|---|---|---|---|
| 3,234,932 | A | 2/1966 | Bird et al. | |
| 3,754,841 | A | 8/1973 | Grabb et al. | |
| 4,211,200 | A | 7/1980 | Rocchio et al. | |
| 4,416,610 | A | 11/1983 | Gallagher, Jr. | |
| 4,499,034 | A | 2/1985 | McAllister | |
| 4,519,423 | A | 5/1985 | Ho et al. | |
| 4,554,786 | A | 11/1985 | Takeuchi et al. | |
| 4,860,795 | A | 8/1989 | Oten | |
| 5,108,266 | A | 4/1992 | Hewitt | |
| 5,188,141 | A | 2/1993 | Cook et al. | |
| 5,291,916 | A | 3/1994 | Kloosterman et al. | |
| 5,622,203 | A | 4/1997 | Givler et al. | |
| 5,816,446 | A | 10/1998 | Steindorf et al. | |
| 6,035,881 | A | 3/2000 | Emmerich et al. | |
| 6,192,911 | B1 | 2/2001 | Barnes | |
| RE37,090 | E | 3/2001 | Kloosterman et al. | |
| 6,220,271 | B1 | 4/2001 | Emmerich et al. | |
| 7,416,326 | B2 | 8/2008 | Sakata et al. | |
| 7,722,132 | B2 | 5/2010 | Carlsson | |
| 9,827,963 | B2 | 11/2017 | Fletcher et al. | |
| 9,879,699 | B2 * | 1/2018 | Fletcher | F04F 5/14 |
| 2006/0016477 | A1 | 1/2006 | Zaparackas | |
| 2006/0082027 | A1 | 4/2006 | Durbin et al. | |
| 2008/0007113 | A1 | 1/2008 | Choi | |
| 2008/0121480 | A1 | 5/2008 | Kawamori et al. | |
| 2011/0132311 | A1 | 6/2011 | Pursifull et al. | |
| 2011/0186151 | A1 | 8/2011 | Sparazynski | |
| 2013/0213510 | A1 | 8/2013 | Burnham et al. | |
| 2013/0233276 | A1 | 9/2013 | Pursifull et al. | |
| 2013/0233287 | A1 | 9/2013 | Leone | |

FOREIGN PATENT DOCUMENTS

| | | |
|---|---|---|
| GB | 2129516 | 5/1984 |
| JP | 2001-295800 | 10/2001 |
| JP | 2007-333166 | 12/2007 |
| JP | 2013-036530 | 2/2013 |
| WO | 2012103597 A1 | 8/2012 |

OTHER PUBLICATIONS

U.S., Non-Final Office Action; U.S. Appl. No. 14/294,727 (dated Oct. 8, 2015).
U.S., Final Office Action; U.S. Appl. No. 14/294,727 (dated Apr. 22, 2016).
PCT, International Search Report and Written Opinion; PCT/US2014/041250 (dated Oct. 27, 2014).
PCT, International Search Report and Written Opinion; PCT/US2015/034844 (dated Aug. 19, 2015).
Hesketh, Howard E. et al.; "Specifying Venturi Scrubber Throat Length for Effective Particle Capture at Minimum Pressure Loss Penalty"; Journal of the Air Pollution Control Association; vol. 33, No. 9; pp. 854-857 (Sep. 1983).
Jawed; "Venturi Tube Design"; archived copy; retrieved from the Internet at https://web.archive.org/web/20140308193542/http://www.thepetrostreet.com/database/Vebtur_Tube_Design_thePetroStreet.pdf pp. 1-46 (Aug. 3, 3014).
CN, Search Report with English Translation issued in Chinese Application No. 201580000323.3 (dated Jul. 5, 2016).
CN, Office Action with English Translation issued in Chinese Application No. 201580000323.3 (dated Jul. 11, 2016).
CN, Office Action and Search Report with English Translation; Chinese Patent Application No. 201410413220.7 (dated Nov. 14, 2016).
CN, First Office Action with English Translation; Chinese Application No. 201710216864.0 (dated May 11, 2018).
CN, Search Repost; Chinese Application No. 201710216864.0 (dated May 11, 2018).
JP, Non-Final Office Action with English Translation; Japanese Application No. 2016-572242 (dated May 21, 2018).
JP, Non-Final Office Action with English Translation; Japanese Application No. 2016-519556 (dated May 18, 2018).
U.S., First Office Action, U.S. Appl. No. 15/791,561 (dated Jul. 26, 2018).
JP, First Office Action with English Translation, Japanese Application No. 2016-568525 (dated Mar. 26, 2019).

* cited by examiner

VENTURI DEVICES WITH DUAL VENTURI FLOW PATHS

RELATED APPLICATIONS

This application is a continuation of U.S. application Ser. No. 14/734,228, filed Jun. 9, 2015, which claims the benefit of U.S. Provisional Application No. 62/009,655, filed Jun. 9, 2014, which is incorporated herein by reference in its entirety.

TECHNICAL FIELD

This application relates to Venturi devices for producing vacuum using the Venturi effect, and more particularly to dual Venturi systems that produce increased suction mass flow rate for a given motive flow rate.

BACKGROUND

Engines, for example vehicle engines, have included aspirators or ejectors for producing vacuum, and/or check valves. Typically, the aspirators are used to generate a vacuum that is lower than engine manifold vacuum by inducing some of the engine air to travel through a Venturi gap. The aspirators may include check valves therein or the system may include separate check valves. When the check valves are separate, they are typically included downstream between the source of vacuum and the device using the vacuum.

During most operating conditions of an aspirator or check valve, the flow is classified as turbulent. This means that in addition to the bulk motion of the air, there are eddies superimposed. These eddies are well known in the field of fluid mechanics. Depending on the operating conditions, the number, physical size and location of these eddies are continuously varying. One result of these eddies being present on a transient basis is that they generate pressure waves in the fluid. These pressure waves are generated over a range of frequencies and magnitudes. When these pressure waves travel through the connecting holes to the devices using this vacuum, different natural frequencies can become excited. These natural frequencies are oscillations of either the air or the surrounding structure. If these natural frequencies are in the audible range and of sufficient magnitude, then the turbulence generated noise can become heard, either under the hood and/or in the passenger compartment. Such noise is undesirable and new aspirators and/or check valves are needed to eliminate or reduce the noise resulting from the turbulent air flow.

Venturi devices may be constructed with one or more suction ports mounted and operatively connected via a Venturi gap to a lower housing with a motive port and discharge port, such as disclosed in co-pending U.S. patent application Ser. No. 14/294,727, filed Jun. 3, 2014, the entirety of which is incorporated by reference herein. However, improvements to generate maximum suction are desirable. Further, manufacturing requirements tend to yield Venturi gaps that taper from the suction port toward the flow path, which creates more turbulence and noise than an aspirator with a symmetrical Venturi gap.

Thus, there is a need to design Venturi devices that more efficiently utilize the suction-producing capabilities of the motive flow, and to design Venturi gaps that generate less turbulence and noise.

SUMMARY

In one aspect, Venturi devices having a body that defines a passageway having a motive section and a discharge section spaced a distance apart from one another to define a Venturi gap and converging toward the Venturi gap and that defines a first suction port and a second suction port generally opposite one another, and each in fluid communication with the Venturi gap, are disclosed. The Venturi gap is generally wider proximate both the first suction port and the second suction port than at a generally central point therebetween.

In one embodiment, the body further defines a chamber spacing the first suction port and the second suction port apart from one another by a distance. An outlet end of the motive section extends into the chamber at a position where the chamber provides fluid flow around the entire outer surface of the outlet end and an inlet end of the discharge section extends into the chamber at a position where the chamber provides fluid flow around the entire outer surface of the inlet end of the discharge section.

In one embodiment, the body further defines a bypass port downstream of the first and second suction ports, and at least one of the first suction port, the second suction port, or the bypass port defines an outlet of a check valve. In another embodiment, the first suction port defines an outlet of a check valve, and the second suction port is in fluid communication with the same check valve through one or more bifurcation passages extending from the check valve to the second suction port. The one or more bifurcation passages are generally parallel to the Venturi gap.

In another embodiment, the fluid flow proximate the first suction port is bifurcated for a portion of the fluid flow to flow through secondary passages to the second suction port, and the Venturi gap is generally wider proximate both the first suction port and the second suction port than at a generally central point therebetween. In this embodiment, the body further defines a chamber spacing the first suction port and the second suction port apart from one another by a distance, and an outlet end of the motive section extends into the chamber at a position where the chamber provides fluid flow around the entire outer surface of the outlet end. Likewise, an inlet end of the discharge section may extend into the chamber at a position where the chamber provides fluid flow around the entire outer surface of the inlet end of the discharge section. In this embodiment, the second suction port includes a cap connected thereto.

In another aspect, systems are disclosed herein in which the Venturi devices described herein are incorporated to generate suction to provide vacuum to a device requiring vacuum, which includes a vacuum reservoir. The system includes the Venturi device, a source of motive flow fluidly connected to the motive section of the Venturi device, and a first device requiring vacuum connected to the first suction port and/or the second suction port of the Venturi device. The system may also include a second device requiring vacuum, and if so, the first device requiring vacuum can be in fluid communication with the first suction port and the second device requiring vacuum can be in fluid communication with the second suction port.

The Venturi device in the system may have a first suction housing connected to the body with a fluid-tight seal to define a first suction passageway for the first suction port, which may be fluidly connected to the first device requiring vacuum. The Venturi device in the system may also have a second suction housing connected to the body with a fluid-tight seal to define a second suction passageway for the second suction port, which may be fluidly connected to the first device requiring vacuum or a second device requiring vacuum.

In one embodiment, the Venturi device includes a cap covering the second suction port, and, proximate the first suction port, the fluid flow is bifurcated through secondary passages to the second suction port.

In another embodiment of the system, at least one of the first suction port, the second suction port, or a bypass port downstream of the first and second suction ports of the Venturi device defines an outlet of a check valve.

DETAILED DESCRIPTION

Figure 1:
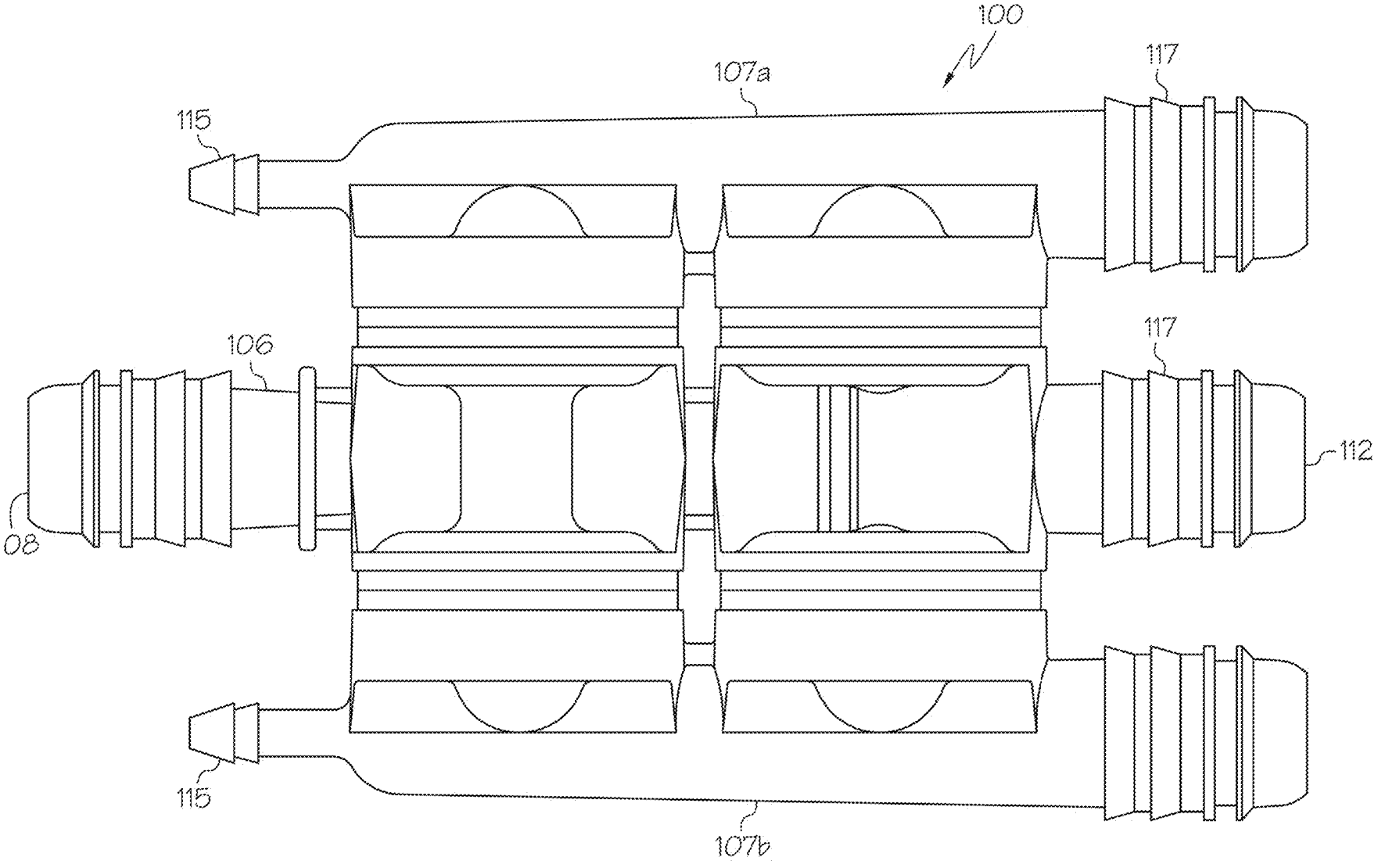
FIG. 1 is a side view of one embodiment of an aspirator-check valve assembly with dual Venturi flow paths.

The following detailed description will illustrate the general principles of the invention, examples of which are additionally illustrated in the accompanying drawings. In the drawings, like reference numbers indicate identical or functionally similar elements.

As used herein, "fluid" means any liquid, suspension, colloid, gas, plasma, or combinations thereof.

FIG. 1 is an external view of an aspirator-check valve assembly, generally identified by reference number 100, for use in an engine, for example, in a vehicle's engine. The engine may be an internal combustion engine that includes a device requiring a vacuum 102. Check valves are normally employed in vehicle systems in the air flow lines between the intake manifold, downstream of the throttle, and the devices requiring vacuum. The engine and all its components and/or subsystems are not shown in the figures, with the exception of a few boxes included to represent specific components of the engine as identified herein, and it is understood that the engine components and/or subsystems may include any commonly found in vehicle engines. For example, a source of motive flow is fluidly connected to a motive section 116 of the aspirator-check valve assembly 100, which may be atmospheric pressure or boosted pressure. While the embodiments in the figures are referred to as aspirators because the motive section 116 is connected to atmospheric pressure, the embodiments are not limited thereto. In other embodiments, the motive section 116 may be connected to boosted pressure, such as the pressures attributed to boosted air produced by a turbocharger, and as such the "aspirator" is now preferably referred to as an ejector.

Figure 2:
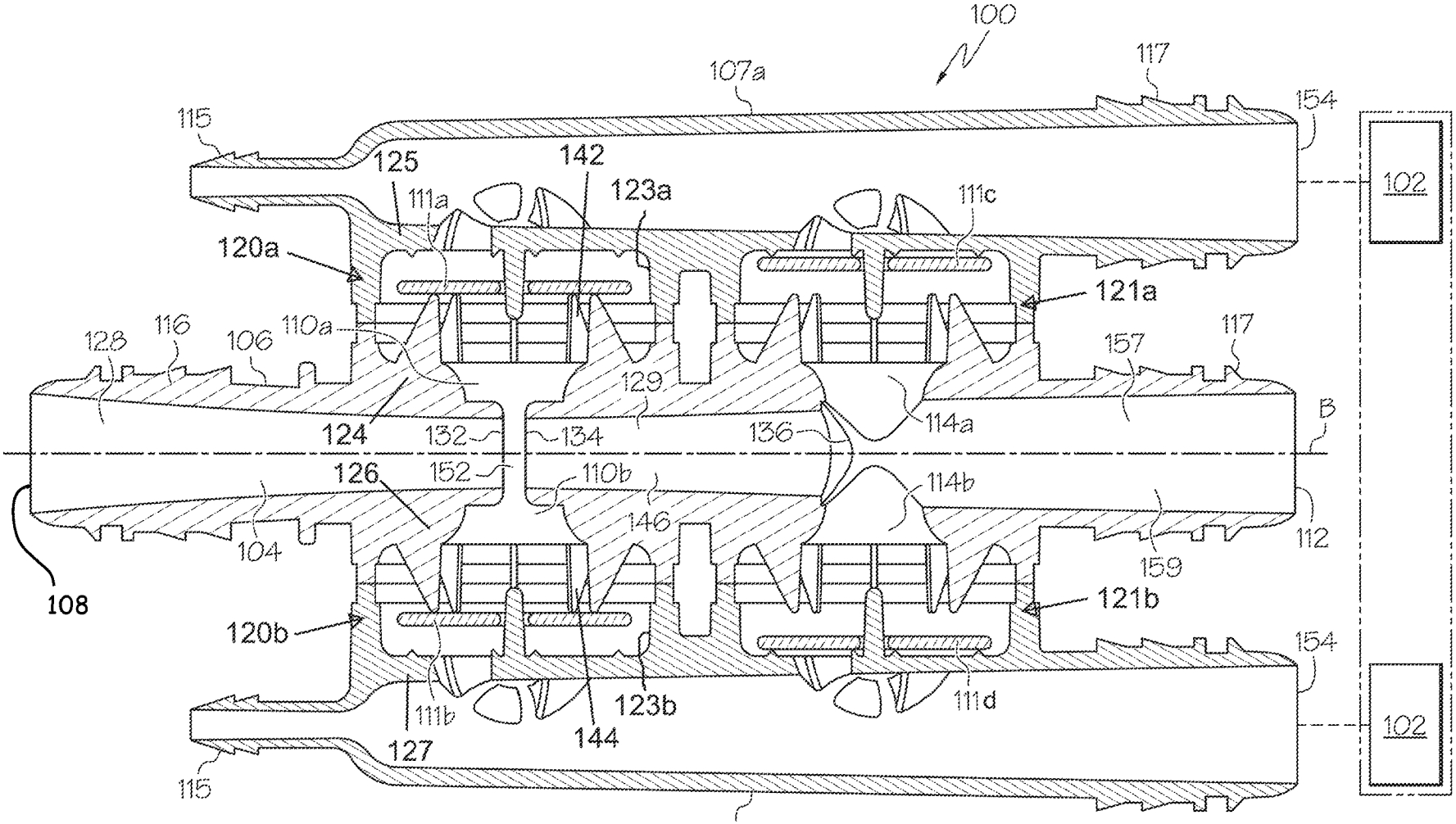
FIG. 2 is a side, longitudinal cross-sectional, plan view of the aspirator-check valve assembly of FIG. 1.

Referring to FIGS. 1 and 2, the aspirator-check valve assembly 100 is connected to a device requiring vacuum 102, and the aspirator-check valve assembly 100 creates vacuum for said device 102 by the flow of air through a passageway 104, extending generally the length of the aspirator, designed to create the Venturi effect. Aspirator-check valve assembly 100 includes a body 106 defining passageway 104 and having four or more ports that are connectable to an engine or components connected thereto. The ports include: (1) a motive port 108, which may be connected to a source of clean air, e.g., from the engine intake air cleaner, that is positioned upstream of a throttle; (2 and 3) a pair of suction ports 110*a*, 110*b*; (4) an aspirator outlet 112, which may be connected to an engine intake manifold downstream of the throttle of the engine; and, optionally, (5) one or more bypass ports 114*a*, 114*b*. The motive fluid flow through the passageway 104 travels from the motive port 108 (high pressure) toward the aspirator outlet 112 (low pressure). In the illustrated embodiment, the suction ports 110*a*, 110*b* are each in fluid communication with a port 154 and an optional auxiliary port 115 via suction housings 107*a* and 107*b*, respectively. The ports 154 may function as inlets connecting the aspirator-check valve assembly to a device requiring vacuum 102. In one embodiment, the device requiring vacuum may be one device connected to both ports 154, or two separate devices each connected to one port 154 as shown in FIG. 2. An additional device requiring vacuum may be connected to one or more of the auxiliary ports 115. Each of the respective ports 108, 112, 115, and 154 may include a connector feature 117 on the outer surface thereof for connecting the respective port to a hose or other component in the engine.

The aspirator-check valve assembly 100 includes the body 106 connected to the upper suction housing 107*a* and connected to the lower suction housing 107*b*. In the illustrated embodiment, upper housing portion 107*a* and lower housing portion 107*b* are identical aside from their attachment locations relative to the body 106, but suction housings 107*a*, 107*b* need not be identical nor are they required to include all of the same components (for example, in an embodiment with only one bypass port 114, the pertinent features of one of the suction housings 107*a*, 107*b*, and the corresponding connective features of body 106, are omitted). The designations of upper, lower, and middle portions are relative to the drawings as oriented on the page, for descriptive purposes, and are not limited to the illustrated orientation when utilized in an engine system. The upper and lower suction housings are joined to the body 106, for example by sonic welding, heating, or other conventional methods for forming an airtight or fluidtight seal therebetween.

Still referring to FIGS. 1 and 2, in the illustrated embodiment, check valves 120*a* and 120*b* and 121*a* and 121*b* are integrated into the aspirator-check valve assembly 100 between the suction housings 107*a* and 107*b* and their respective suction ports 110*a* and 110*b* and bypass ports 114*a* and 114*b*, respectively. Alternately, any one or more of the check valves 120*a*, 120*b*, 121*a*, 121*b* may be omitted or may be provided as an external component of an aspirator system. Check valves 120*a*, 120*b* are preferably arranged to prevent fluid from flowing from the suction ports 110*a*, 110*b* to the application device 102. In one embodiment, the device requiring vacuum 102 is a vehicle brake boost device, a fuel vapor purging system, an automatic transmission, or pneumatic or hydraulic valve.

The check valves 120*a*, 120*b* each include a first valve seat 124, 126 as part of the body 106. The first valve seat 124 defines the first suction port 110*a*, and the second valve seat 126 defines the second suction port 110*b*, which both allow for air flow communication with air passageway 104. In FIG. 2, the first valve seat 124 includes a plurality of radially spaced fingers 142 and the second valve seat 126 includes a plurality of radially spaced fingers 144 extending into a cavity 123*a*, 123*b* defined by the check valves 120*a*, 120*b* to form a support/seat for a sealing member 111*a*, 111*b*. The check valves 120*a*, 120*b* also include a second valve seat 125, 127 as part of the suction housings 107*a* and 107*b* against which the sealing member 111*a*, 111*b* can be seated, for example, in a closed position of the check valve. Similarly, check valves 121*a*, 121*b* for the bypass ports 114*a*, 114*b* include generally the same components as check valves 120*a* and 120*b* and as such, the labels are not repeated in the drawings other than for sealing members 111*c*, 111*d*.

Figure 7:
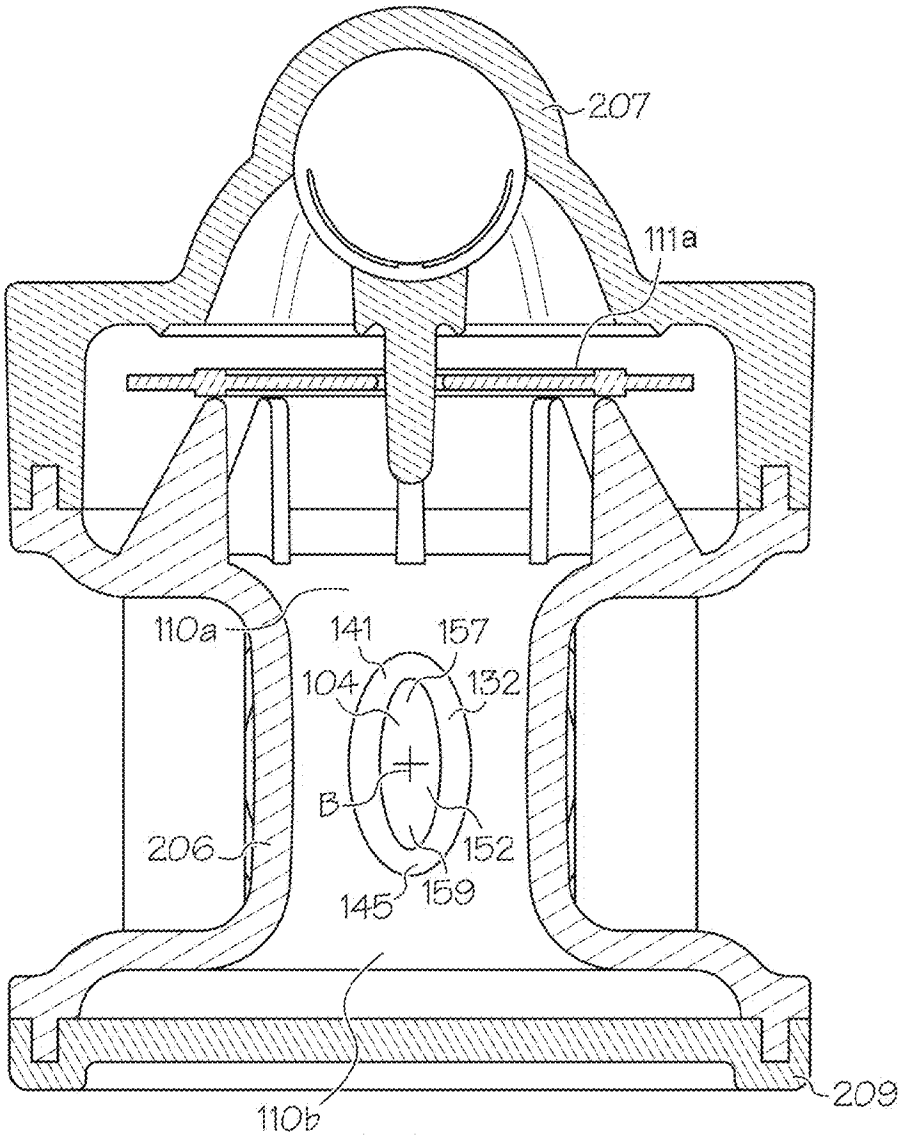
FIG. 7 is a transverse, cross-sectional plan view of the aspirator-check valve assembly of FIG. 4 taken along line 7-7.

The body 106 defines passageway 104 along a central longitudinal axis B bisected by the suction ports 110*a*, 110*b*. The inner passageway 104 includes a first tapering portion 128 (also referred to herein as the motive cone) in the motive section 116 of the body 106 coupled to a second tapering portion 129 (also referred to herein as the discharge cone) in the discharge section 146 of the body 106. Here, the first tapering portion 128 and the second tapering portion 129 are aligned end to end having the motive outlet end 132 facing the discharge inlet end 134 and defining a Venturi gap 152 therebetween (shown in greater detail in FIG. 3), which defines a fluid junction placing the suction ports 110*a*, 110*b* generally opposite one another and each in fluid communication with the Venturi gap, and, hence, both the motive section 116 and the discharge section 146. The Venturi gap 152 as used herein means the lineal distance between the motive outlet end 132 and the discharge inlet end 134. The interior surface of the motive outlet end 132 and the discharge inlet end 134 is ellipse-shaped (for example, as shown in FIG. 7 with respect to an alternate embodiment 200 of the aspirator-check valve assembly), but may alternately have a polygonal or curved form.

The bypass ports 114*a*, 114*b* may intersect the second tapering section 129 adjacent to, but downstream of, the discharge outlet end 136. The body 106 may thereafter, i.e., downstream of this intersection of the bypass port 114, continue with a cylindrically uniform inner diameter until it terminates at the aspirator outlet 112. In another embodiment (not shown), the bypass ports 114*a*, 114*b* and/or the suction ports 110*a*, 110*b* may be canted relative to axis B and/or to one another. In the embodiment of FIGS. 1 and 2, the suction ports 110*a*, 110*b* and the bypass ports 114*a*, 114*b* are aligned with one another and have the same orientation relative to the body's central longitudinal axis B. In another embodiment, not shown, the suction ports 110*a*, 110*b* and the bypass ports 114*a*, 114*b* may be offset from one another and can be positioned relative to components within the engine that they will connect to for ease of connection.

Figure 3:
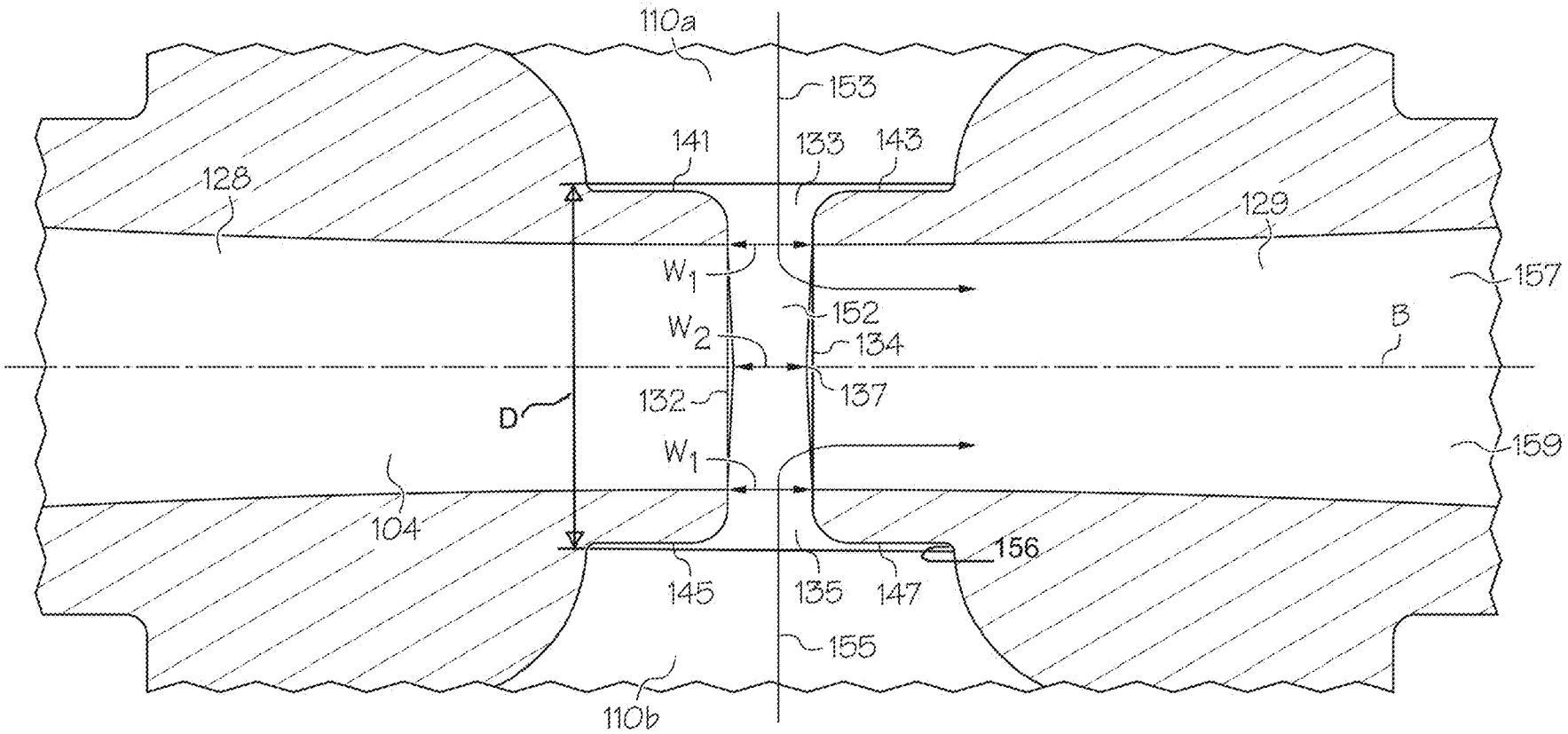
FIG. 3 is a detailed view of the Venturi gap of the aspirator-check valve assembly of FIGS. 1 and 2.

Referring now to FIG. 3, the Venturi gap 152 between the motive outlet end 132 and the discharge inlet end 134 is shown in greater detail. The body 106 further defines a chamber 156 spacing the first suction port 110*a* and the second suction port 110*b* apart from one another by a distance D. The outlet end 132 of the motive section extends into the chamber 156 at a position where the chamber 156 provides fluid flow around the entire outer surface of the outlet end 132, and an inlet end 134 of the discharge section 146 extends into the chamber 156 at a position where the chamber 156 provides fluid flow around the entire outer surface of the inlet end 134. Suction port 110*a* is positioned proximate a top portion 141 of the motive outlet end 132 and a top portion 143 of the discharge inlet end 134, which define an upper portion 133 of the Venturi gap 152. Suction port 110*b* is positioned proximate a lower portion 145 of the motive outlet end 132 and a lower portion 147 of the discharge inlet end 134, which define a lower portion 135 of the Venturi gap 152. The width of the Venturi gap 152 tapers symmetrically from a maximum width $W_1$ at the upper and lower portions 133, 135 of the Venturi gap 152 proximate the suction ports 110 to a minimum width $W_2$ at a center portion 137 thereof. As a result, the void defined by the Venturi gap 152 is symmetrical about a plane bisecting the passageway 104 into upper and lower halves 157, 159 (in the illustrated embodiment, above and below axis B), thereby improving flow conditions and decreasing turbulence and resultant noise as fluid flows through the Venturi gap 152 as compared to aspirator systems incorporating Venturi gaps with asymmetrical (e.g., conical or tapered) configurations.

The disclosed system, incorporating a pair of suction ports 110*a*, 110*b* on either side of the Venturi gap 152, also provides improved suction flow rate for a given motive flow and discharge pressure as compared to a system incorporating a single suction port 110 because the disclosed system provides greater capacity to utilize the Venturi effect created by the motive flow through passageway 104. With continued reference to FIG. 3, arrows 153 and 155 indicate the fluid flow path through the upper and lower suction ports 110*a*, 110*b*. Venturi forces generated by the motive flow through the upper half 157 of the passageway 104 across the Venturi gap 152 yield suction primarily along flow path 153 through suction port 110*a*. Venturi forces generated by the motive flow through the lower half 159 of the passageway 104 across the Venturi gap 152 yield suction primarily along flow path 155 through suction port 110*b*.

In contrast, in an aspirator system incorporating only one suction port at the Venturi gap (e.g., only suction port 110*a* or only suction port 110*b*), only the Venturi forces generated on the half 157, 159 of the passageway 104 in which the suction port is located can be efficiently harnessed to create suction, because the suction port does not have sufficient access to the motive flow through the opposite half 157, 159 of the passageway 104 due to interference by the motive flow itself as it crosses the Venturi gap 152. For example, in an aspirator system with suction port 110*a* but not 110*b*, the motive flow through upper half 157 of passageway 154 contributing to flow path 153 is fully utilized, but the motive flow through lower half 159 cannot be efficiently harnessed due to its distance from the suction port 110*a*. Thus, the disclosed system 100 provides increased total suction flow rate (adding the flow rates of the suction ports 110*a*, 110*b* together) for a given motive flow by providing more access points about the perimeter of the motive outlet end 132 at which to utilize the Venturi effect. In an alternate embodiment, additional suction ports may be added to further increase efficiencies, such as an additional two suction ports orthogonal to both the passageway 104 and the suction ports 110*a*, 110*b*.

Because aspirators and aspirator-check valve assemblies are often manufactured via injection molding, formation of a symmetrical Venturi gap in prior art aspirator systems as presently disclosed is difficult and/or not economically feasible due to limitations of the manufacturing process. To form the Venturi gap, a core pin must be employed to preserve the void in the completed product, and the core pin must be subsequently removed. To ensure the strength and integrity of the finished product, the core pin should be inserted and removed through openings intended to be present in the completed product. Extra holes should not be formed and subsequently patched expressly for the purpose of inserting and removing a core pin because this would introduce weak points in the product and limit its useful life. And, to facilitate removal of the core pin, the core pin should be slightly conical in shape, tapering toward the interior of the product.

Thus, in existing aspirator systems incorporating only one suction port which communicates with the passageway 104 on only one side of the longitudinal axis B of the Venturi gap, there is only one natural opening in passageway 104 at the Venturi gap region through which a core pin may be inserted. Thus, the conical shape of the core pin used to create the void yields an asymmetrical Venturi gap that is tapered along its entire height from upper portion 133 to lower portion 135 as labeled in FIG. 3. In contrast, the disclosed aspirator-check valve assembly 100 includes two suction ports 110*a*, 110*b* that communicate with both upper portion 133 and lower portion 135 of the Venturi gap 152, so passageway 104 inherently includes two openings, one at the top to communicate with suction port 110*a* and one at the bottom to communicate with suction port 110*b*. These openings facilitate insertion of a pair of conical core pins to symmetrically form the disclosed Venturi gap 152 by inserting the pins through both portions 133, 135 to meet at center portion 137, thereby providing a mechanism to efficiently create a symmetrical Venturi gap 152 through an injection molding process, without negatively impacting the structural integrity of the finished product.

Figure 4:
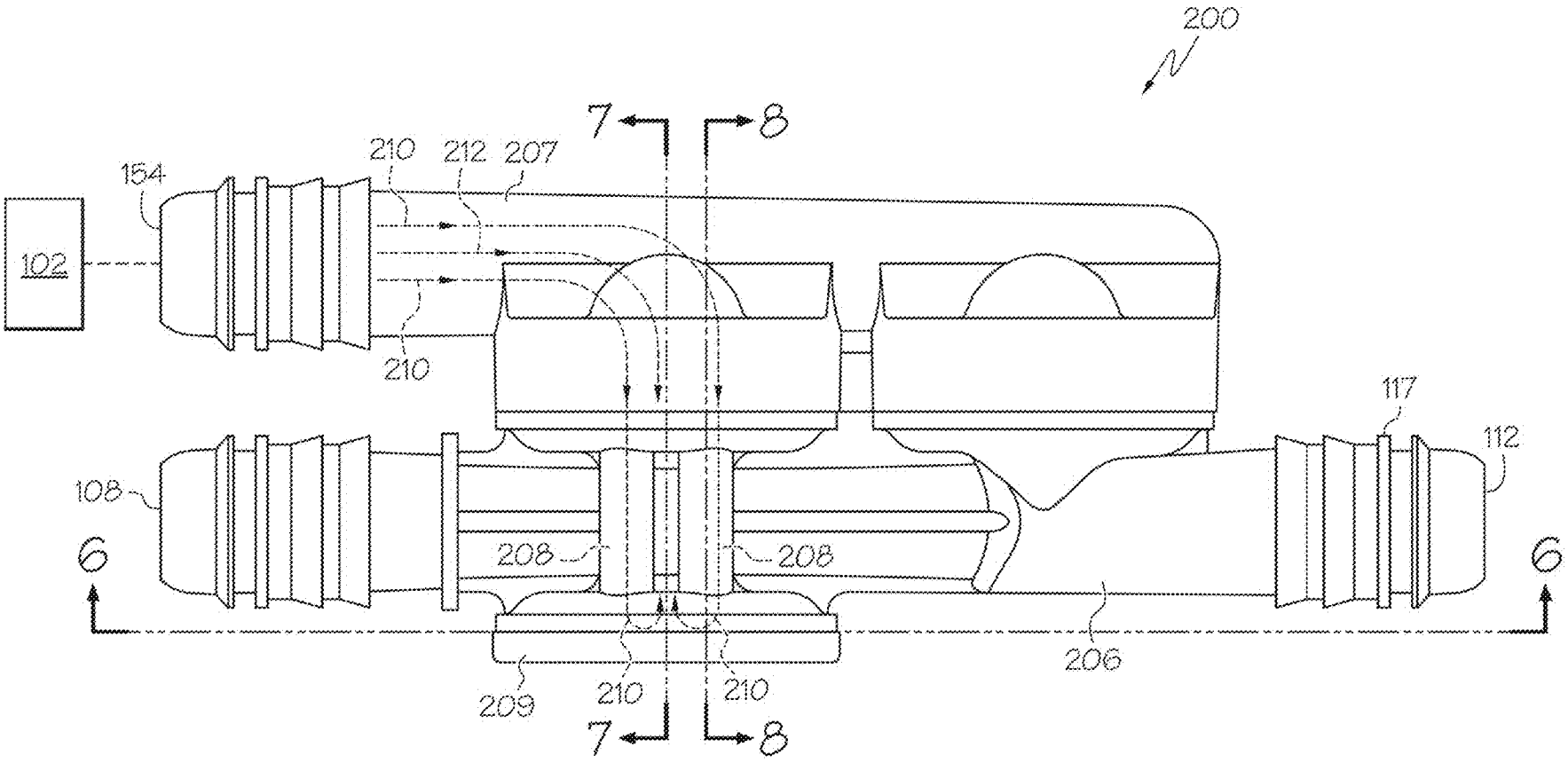
FIG. 4 is a side view of a second embodiment of an aspirator-check valve assembly with dual Venturi flow paths.
Figure 5:
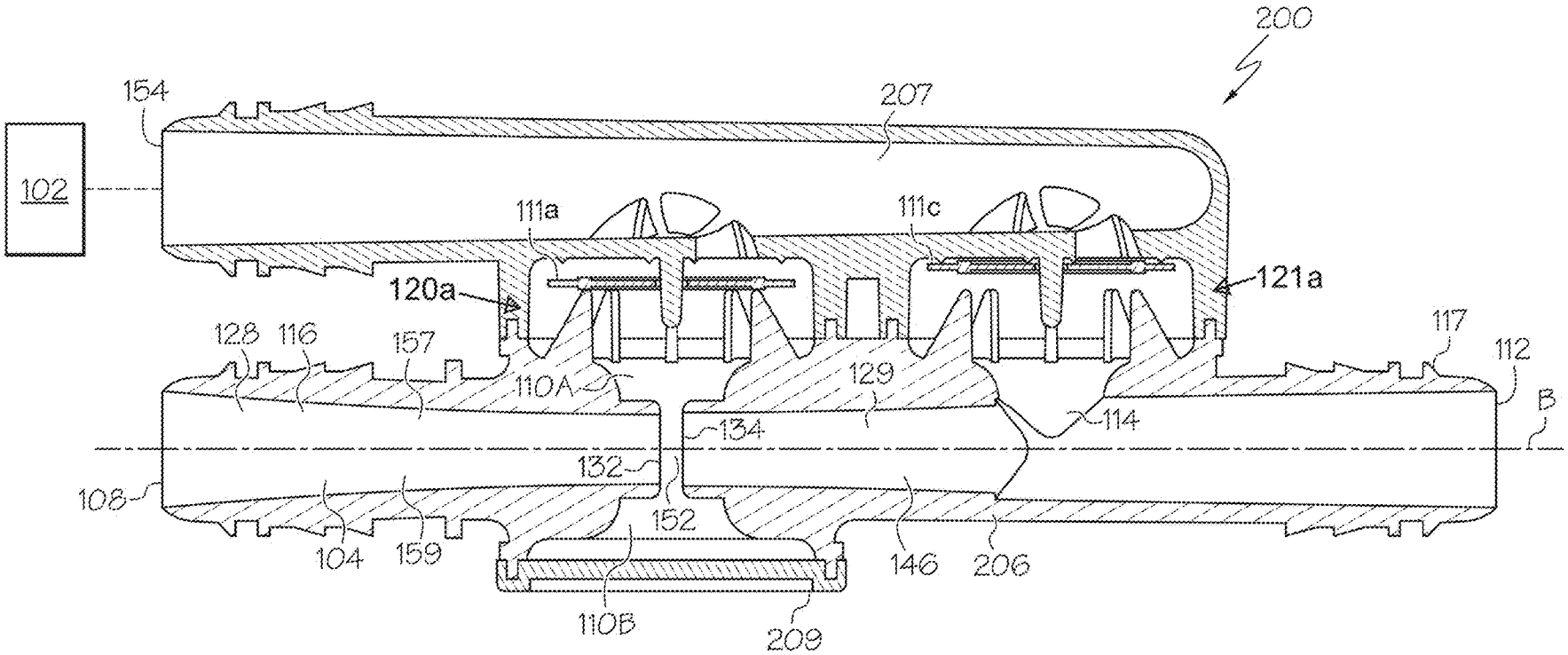
FIG. 5 is a side, longitudinal cross-sectional, plan view of the aspirator-check valve assembly of FIG. 4.

Referring now to FIGS. 4-8, an alternate embodiment of an aspirator-check valve assembly, generally designated 200, is disclosed. As illustrated in FIGS. 4 and 5, aspirator-check valve assembly 200 is connected to a device requiring vacuum 102, and includes a body 206 defining passageway 104 and having a variety of ports including a motive port 108, a pair of suction ports 110*a*, 110*b*, an aspirator outlet 112, and, optionally, one or more bypass ports 114. A suction housing 207 is connected to the body 206 and together form at least one check valve 120*a* or 121*a* including a sealing member 111*a*, 111*b*, respectively. Components of aspirator-check valve 200 not described below are understood to be analogous to those described above with respect to the aspirator-check valve assembly 100. The body 206, the suction housing 207, and a cap 209 are joined together, which may be accomplished by sonic welding, heating, or other conventional methods for forming an airtight seal therebetween.

The body 206 defines passageway 104 along a central longitudinal axis B bisected by the suction ports 110*a*, 110*b*. The inner passageway 104 includes a first tapering portion 128 in the motive section 116 of the body 206 coupled to a second tapering portion 129 in the discharge section 146 of the body 206. The first tapering portion 128 and the second tapering portion 129 are aligned end to end having the motive outlet end 132 facing the discharge inlet end 134 and defining a Venturi gap 152 therebetween which has the same basic symmetrical shape and functionality as earlier described with respect to the aspirator-check valve assembly 100. The details and benefits shown and described above with respect to the aspirator-check valve assembly 100, including the manufacturing advantages and the discussion of FIG. 3 regarding efficient utilization of the Venturi effect across two suction ports 110*a*, 110*b*, applies equivalently to the aspirator-check valve assembly 200.

Figure 6:
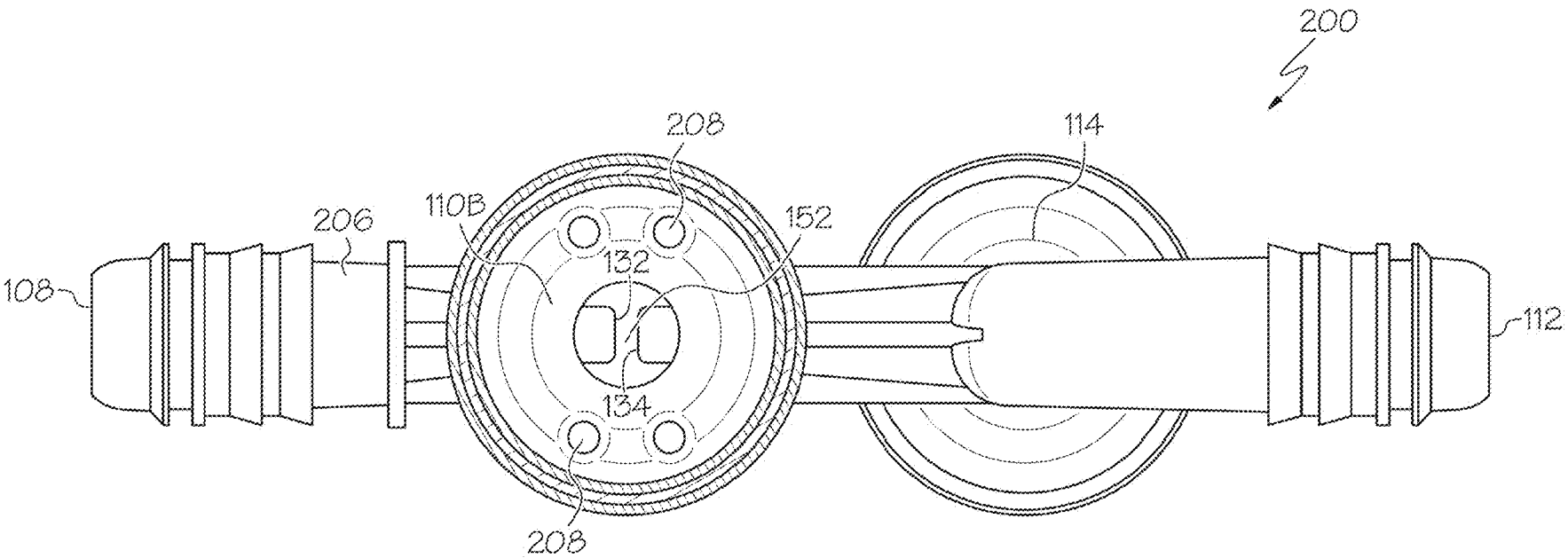
FIG. 6 is a bottom, cross-sectional plan view of the aspirator-check valve assembly of FIG. 4 taken along line 6-6.
Figure 8:
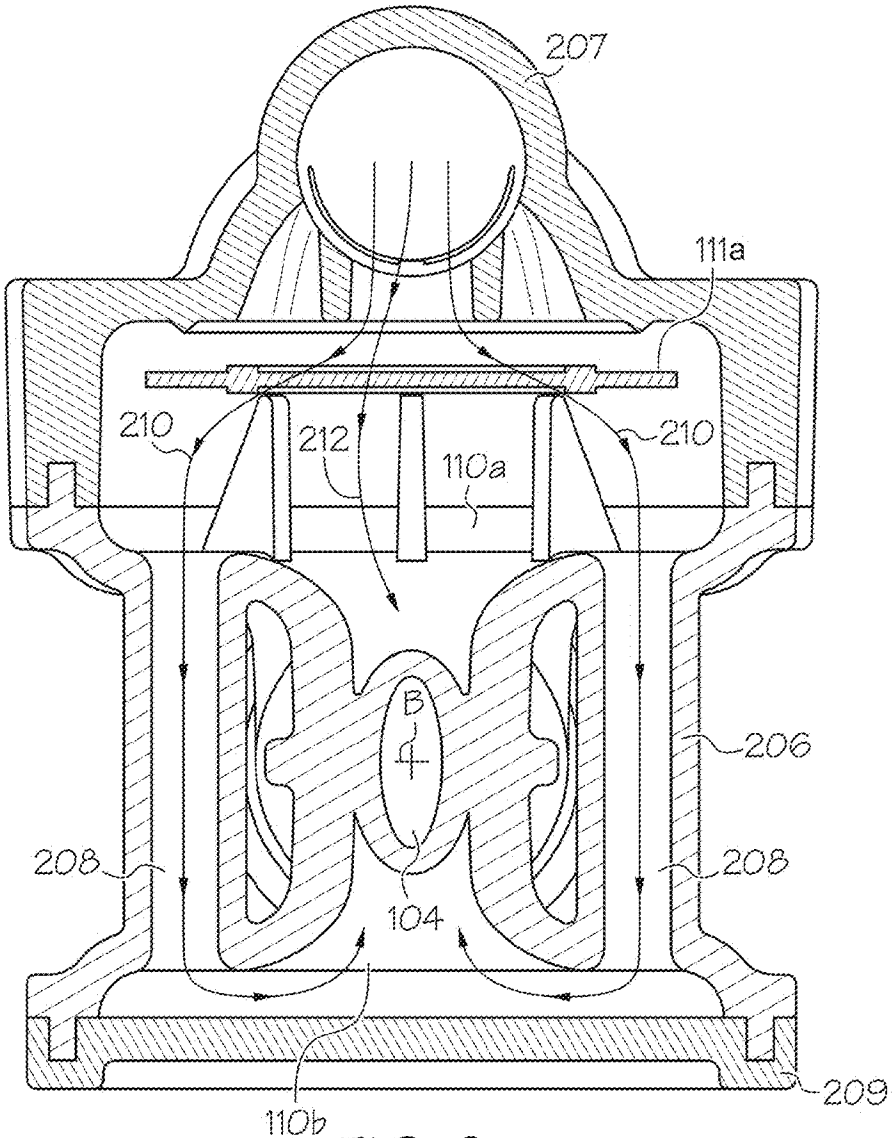
FIG. 8 is a transverse, cross-sectional plan view of the aspirator-check valve assembly of FIG. 4 taken along line 8-8.

Referring now to FIGS. 6-8, each of which illustrates cross-sectional portions of the aspirator-check valve assembly 200 taken along the lines indicated in FIG. 4, the body 206 includes one or more passages 208 (four, in the illustrated embodiment, best seen in FIGS. 6 and 8) providing fluid communication to the lower suction port 110*b*. In particular, fluid flow proximate the first suction port is bifurcated for a portion of the fluid flow to flow through the one or more passages 208 to the second suction port 110*b*, rather than into the first suction port 110*a*.

As illustrated, passages 208 are cylindrical tubes that are integrated into the body 206 itself, but passages 208 may alternately be formed into any shape and may be provided as external components, for example in the form of hoses that link the suction ports 110*a*, 110*b* via ports therein provided for this purpose. Passages 208 may be generally parallel to the Venturi gap. The passages 208 do not directly fluidly communicate with the motive section 116 or the discharge section 146. Instead, the passages 208 fluidly communicate with the second suction port 110*b*, which fluidly communicates with the Venturi gap 152. Passages 208 provide a flow path 210 (or a plurality of flow paths 210) from port 154 (in communication with the device 102), through the suction housing 207, to the second suction port 110*b* for suction generation as a result of the fluid flow through the lower half 159 of passageway 104, in addition to the conventional flow path 212 for suction generated by suction port 110*a* as a result of fluid flow through the upper half 157 of passageway 104. As a result, for a given motive flow through the Venturi gap 152, the device requiring vacuum 102 can efficiently harness the suction generated by both suction ports 110*a*, 110*b*.

Also, this design allows a single check valve 120*a* proximate to suction port 110*a* to control the flow through both suction ports 110*a*, 110*b*, thereby eliminating the need for a dedicated check valve for suction port 110*b*, saving space and manufacturing costs.

Further, if desired, the passages 208 may be sealed (selectively or permanently) to block flow path 210, and the cap 209 may be replaced with additional components (including, for example, an additional check valve) to redirect suction generated at suction port 110*b* to a different device 102, thereby yielding a configuration similar to that of the aspirator-check valve assembly 100. In one embodiment, both the passages 208 and the cap 206 may be selectively openable and closeable to allow a user to selectively apply generated suction to a variety of devices 102.

Figure 9:
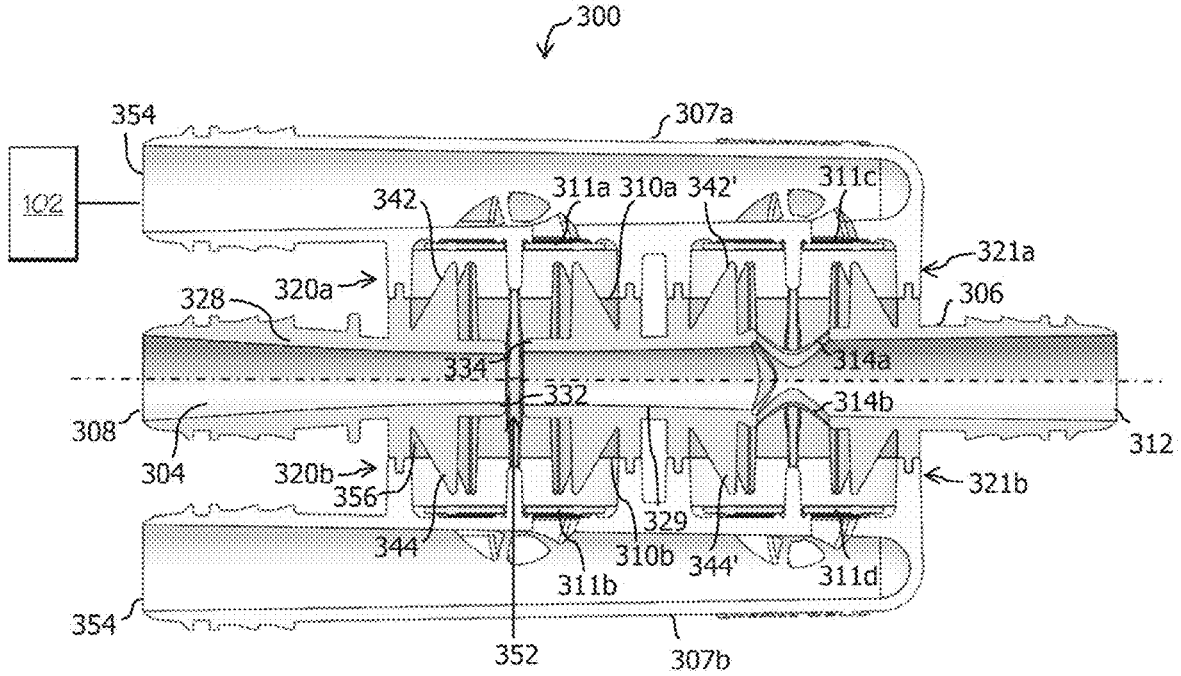
FIG. 9 is a side, longitudinal cross-sectional, plan view of a third embodiment of an aspirator-check valve assembly.
Figure 10:
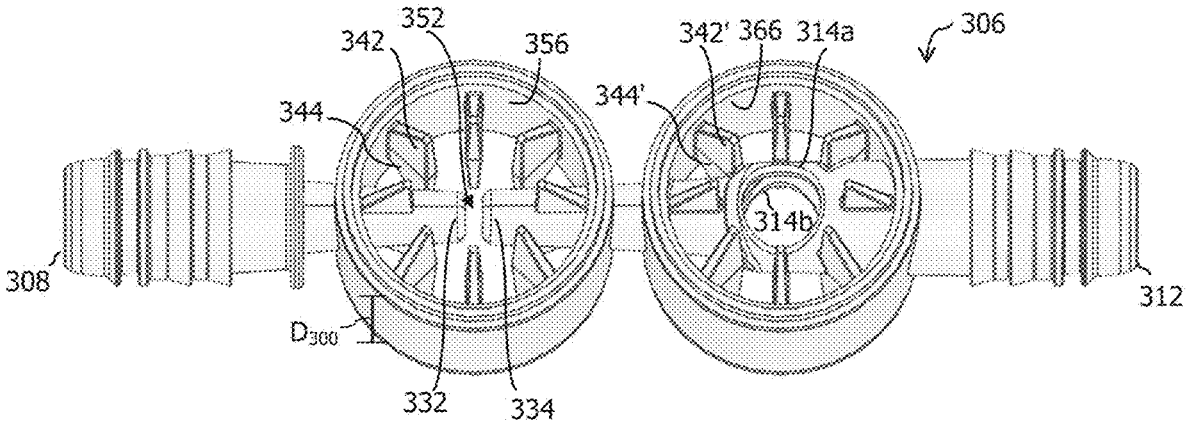
FIG. 10 is a side, perspective view of just the body of the aspirator-check valve assembly of FIG. 10.

Referring now to FIGS. 9-10, an alternate embodiment of a Venturi device, generally designated 300, is disclosed. The Venturi device 300 is connected to a device requiring vacuum 102, and includes a body 306 defining passageway 304 and having a variety of ports including a motive port 308, a pair of suction ports 310*a*, 310*b*, an aspirator outlet 312, dual suction housings 307*a*, 307*b* connected to the body 306 with fluidtight/airtight seals, for example by sonic welding, heating, or other conventional methods for forming such seals therebetween, and, optionally, dual bypass ports 314*a*, 314*b*. In one embodiment, the suction housings 307*a*, 307*b* and the body 406, together, form at least one check valve 320*a*, 320*b*, 321*a*, and 321*b*, and may have any combination thereof, including all four check valves as shown in FIG. 9. Components of the Venturi device 300 not described below are understood to be analogous to those described above with respect to the other embodiments.

The body 306 defines passageway 304 along a central longitudinal axis bisected by the suction ports 310*a*, 310*b*. The inner passageway 304 includes a first tapering portion 328 and the second tapering portion 329 aligned end to end having the motive outlet end 332 facing the discharge inlet end 334 and defining a Venturi gap 352 therebetween which has the same basic symmetrical shape and functionality as earlier described with respect to the aspirator-check valve assembly 100, in particular the structure and benefits shown and described above with respect to FIG. 3, including the manufacturing advantages and efficient utilization of the Venturi effect across two suction ports 310*a*, 310*b*.

The body 306 of FIGS. 9 and 10 further defines a chamber 356 spacing the first suction port 310*a* and the second suction port 310*b* apart from one another by a distance $D_{300}$. The motive outlet end 332 extends into the chamber 356 at a position where the chamber 356 provides fluid flow around the entire outer surface of the motive outlet end 332, and the discharge inlet end 334 extends into the chamber 356 at a position where the chamber 356 provides fluid flow around the entire outer surface of the inlet end 334. The width of the Venturi gap 352 tapers symmetrically generally proximate the first suction port 310*a* and the second suction port 310*b* (the widest points) toward a central point therebetween. Accordingly, the Venturi gap 352 is wider proximate both the first suction port 310*a* and the second suction port 310*b* than at a generally central point between the first and second suction ports 310*a*, 310*b*. Widths as labeled in FIG. 3 are applicable here.

The chamber 356 defined by the body 306 includes a plurality of fingers 342 extending radially inward and axially away (upward in the figures) from the passageway 304 of the body 306. The plurality of fingers 342 are arranged radially as protrusion from an inner wall of the chamber 356 in an orientation where immediately adjacent neighboring fingers are spaced a distance apart from one another. The plurality of fingers 342 define a seat for the sealing member 311*a* as part of check valve 320*a*. Similarly, the check valve 321*a*, if the bypass port(s) 314*a* is present, has a chamber 366 defined by the body 306 that includes a plurality of fingers 342' extending radially inward and radially away (upward in the drawings) from the passageway 304 of the body 306 that collectively define a seat for the sealing member 311*c*. The plurality of fingers 342' are arranged radially as protrusion from an inner wall of the chamber 366 in an orientation where immediately adjacent neighboring fingers are spaced a distance apart from one another. Each of the plurality of fingers 342, 342' has a base that is wider than at an apex thereof.

The apexes of the plurality of fingers 342 collectively define the seat for the sealing member 311*a* for an open position, and the apexes of fingers 342' define the seat for sealing member 311*c* for an open position. In the embodiment of FIGS. 9 and 10, since check valves 320*b* and 321*b* are present, each of the plurality of fingers 342 include a mirror image finger 344 beginning at its base and projecting axially away from the base and terminating at an apex. The mirror image fingers 344 are integral with the fingers 342. The apexes of the mirror image fingers 344 collectively define the seat for sealing member 311*b*. Similarly, the mirror image fingers 344', if the fingers 342' are present, are integral with the plurality of fingers 342', begin at the base thereof, and extend axially away from the base thereof (downward in the figures). The apexes of the plurality of mirror image fingers 344' define the seat for sealing member 311*d*.

Figure 11:
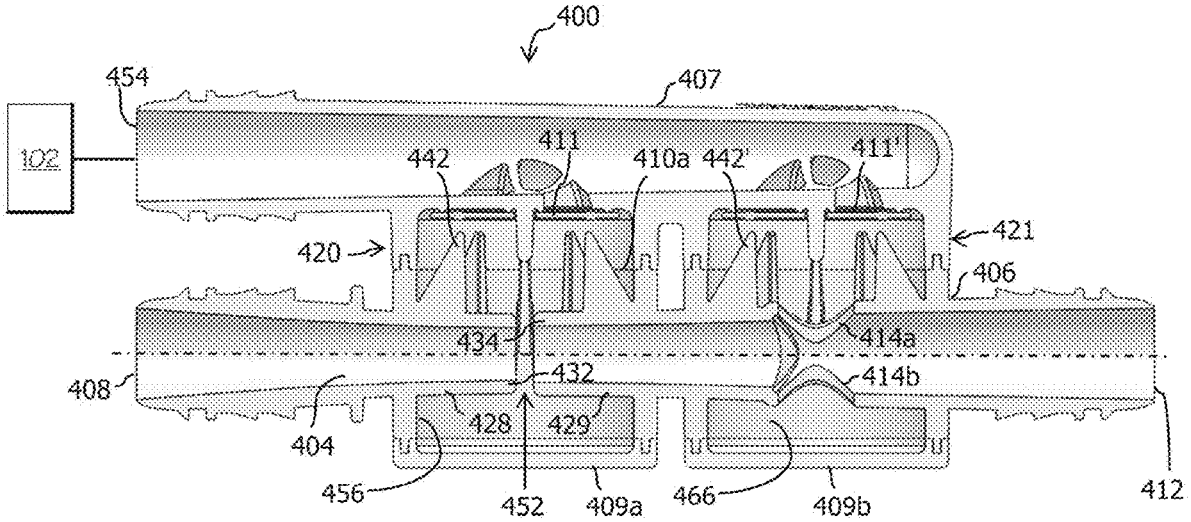
FIG. 11 is a side, longitudinal cross-sectional, plan view of a fourth embodiment of an aspirator-check valve assembly.
Figure 12:
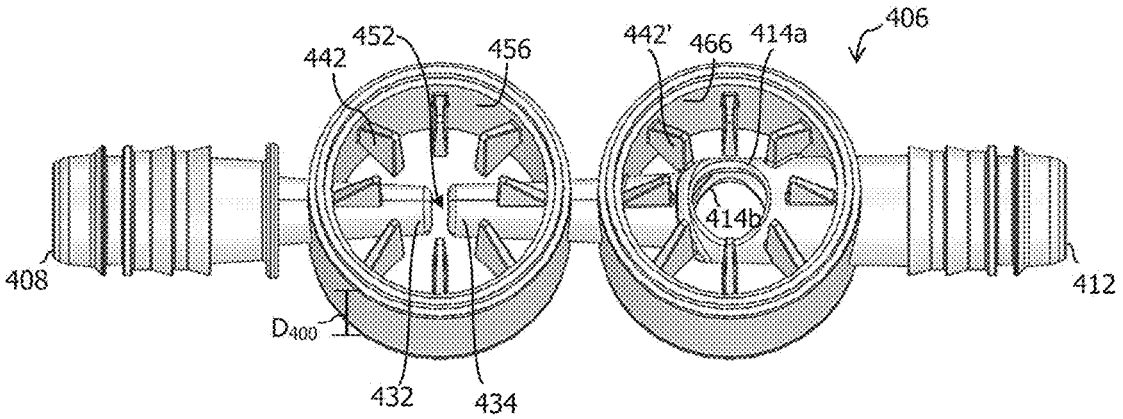
FIG. 12 is a side, perspective view of just the body of the aspirator-check valve assembly of FIG. 11.

Referring now to FIGS. 11-12, an alternate embodiment of a Venturi device, generally designated 400, is disclosed. The Venturi device 400 is connected to a device requiring vacuum 402, and includes a body 406 defining passageway 404 and having a variety of ports including a motive port 408, a pair of suction ports 410*a*, 410*b*, an aspirator outlet 412, a suction housing 407 connected to the body 406 with fluidtight/airtight seals, for example by sonic welding, heating, or other conventional methods for forming such seals therebetween, and, optionally, dual bypass ports 414*a*, 414*b*. The suction housing 407 and the body 406, together, form check valve 420 and/or 421, which if present include a sealing member 411, 411', respectively. Additionally, Venturi device 400 includes a first cap 409*a* and a second cap 409*b* defining an end of the chamber 456 and an end of chamber 466, respectively. The first and second caps 409*a*, 409*b* are connected thereto with fluidtight/airtight seals, for example by sonic welding, heating, or other conventional methods for forming such seals. Components of the Venturi device 400 not described below are understood to be analogous to those described above with respect to the other embodiments.

The body 406 defines passageway 404 along a central longitudinal axis bisected by the suction ports 410*a*, 410*b*. The inner passageway 404 includes a first tapering portion 428 and the second tapering portion 429 aligned end to end with the motive outlet end 432 facing the discharge inlet end 434 and defining a Venturi gap 452 therebetween. The Venturi gap 452 has the same basic symmetrical shape and functionality as earlier described with respect to the aspirator-check valve assembly 100, in particular the structure and benefits shown and described above with respect to FIG. 3, including the manufacturing advantages and efficient utilization of the Venturi effect across two suction ports 410*a*, 410*b*.

The body 406 of FIGS. 11 and 12 further defines a chamber 456 spacing the first suction port 410*a* and the second suction port 410*b* apart from one another by a distance $D_{400}$. The motive outlet end 432 extends into the chamber 456 at a position where the chamber 456 provides fluid flow around the entire outer surface of the motive outlet end 432, and the discharge inlet end 434 extends into the chamber 456 at a position where the chamber 456 provides fluid flow around the entire outer surface of the inlet end 434. The width of the Venturi gap 452 tapers symmetrically generally proximate the first suction port 410*a* and the second suction port 410*b* (the widest points) toward a central point therebetween. Accordingly, the Venturi gap 452 is wider proximate both the first suction port 410*a* and the second suction port 410*b* than at a generally central point between the first and second suction ports 410*a*, 410*b*. Widths as labeled in FIG. 3 are applicable here.

The chamber 456 defined by the body 306 includes a plurality of fingers 442 extending radially inward and axially away (upward in the figures) from the passageway 404 of the body 406. The plurality of fingers 442 are arranged radially as protrusion from an inner wall of the chamber 456 in an orientation where immediately adjacent neighboring fingers are spaced a distance apart from one another. The plurality of fingers 442 define a seat for the sealing member 411 as part of check valve 420. Similarly, the check valve 421, if the bypass port(s) 414*a*, 414*b* are present, has a chamber 466 defined by the body 406 that includes a plurality of fingers 442' extending radially inward and radially away (upward in the drawings) from the passageway 404 of the body 406 that collectively define a seat for the sealing member 411'. The plurality of fingers 442' are arranged radially as protrusion from an inner wall of the chamber 466 in an orientation where immediately adjacent neighboring fingers are spaced a distance apart from one another. Each of the plurality of fingers 442, 442' has a base that is wider than at an apex thereof. The apexes of the plurality of fingers 442 collectively define the seat for the sealing member 411 for an open position, and the apexes of fingers 442' define the seat for sealing member 411' for an open position.

Having described the invention in detail and by reference to preferred embodiments thereof, it will be apparent that modifications and variations are possible without departing from the scope of the invention which is defined in the appended claims.

What is claimed is:

1. A Venturi device comprising:

a body defining a passageway having a motive section and a discharge section converging toward one another and defining a chamber having an open first end and an open second end into which an outlet end of the motive section and an inlet end of the discharge section both extend to a position providing fluid flow around the entire outer surface of the outlet end and the inlet end, wherein the inlet end and the outlet end are spaced a lineal distance apart from one another to define a Venturi void therebetween, and divide the chamber into a first portion and a second portion in fluid communication with one another above and below the outlet end and inlet end and through the Venturi void;

a suction housing defining a suction passageway sealingly connected to the open first end of the chamber for fluid communication therewith and with the Venturi void, wherein the suction housing and the chamber of the body collectively define a check valve chamber; and a cap sealingly connected to the open second end of the chamber;

wherein the first portion of the chamber has a plurality of spaced apart fingers protruding radially inward and axially upward away from the passageway of the body from an inner wall of the chamber, which define a seat for an open position within the check valve chamber.

2. The Venturi device of claim 1, wherein each of the plurality of fingers has a base that is wider than at an apex.

3. The Venturi device of claim 1, wherein the body further defines a bypass port downstream of the chamber.

4. The Venturi device of claim 1, wherein the Venturi gap is wider proximate both the first suction port and the second suction port than at a central point therebetween.

5. The Venturi device of claim 1, wherein the fluid flow proximate the first suction port is bifurcated for a portion of the fluid flow to flow through secondary passages to the second suction port.

6. A Venturi device comprising:

a body defining a passageway having a motive section and a discharge section spaced a distance apart from one another to define a Venturi gap and both having inner tapering portions converging toward the Venturi gap, and defining a first suction port and a second suction port opposite one another, and each in fluid communication with the Venturi gap;

wherein the body further defines a chamber spacing the first suction port and the second suction port apart from one another by a distance and having an outlet end of the motive section extending into the chamber at a position where the chamber provides fluid flow around the entire outer surface of the outlet end and an inlet end of the discharge section extending into the chamber at a position where the chamber provides fluid flow around the entire outer surface of the inlet end of the discharge section;

wherein the end faces of the outlet end of the motive section and of the inlet end of the discharge section defining the Venturi gap both taper from an upper portion and a lower portion of the Venturi gap to a central point at a plane bisecting the passageway into upper and lower halves, thereby the Venturi gap has a width that tapers symmetrically from a maximum width $W_1$ at the upper portion and the lower portion of the Venturi gap proximate the suction ports to a minimum width $W_2$ at the center point.

7. The Venturi device of claim 6, wherein the chamber includes a plurality of fingers extending radially inward and axially away from the passageway of the body; wherein the plurality of fingers define a seat for an open position for a check valve.

8. The Venturi device of claim 7, wherein each of the plurality of fingers has a base that is wider than at an apex.

9. The Venturi device of claim 8, wherein each of the plurality of fingers includes a mirror image finger beginning at the base and projecting axially away from the base.

10. The Venturi device of claim 6, wherein the body further defines a bypass port downstream of the first and second suction ports.

11. The Venturi device of claim 10, wherein at least one of the first suction port, the second suction port, or the bypass port defines an outlet of a check valve.

12. The Venturi device of claim 11, wherein the first suction port defines an outlet of a check valve, and the second suction port is in fluid communication with the same check valve through one or more bifurcation passages extending from the check valve to the second suction port.

13. The Venturi device of claim 12, wherein the one or more bifurcation passages are parallel to the Venturi gap.

14. A system comprising:

a Venturi device comprising:

a body defining a passageway having a motive section and a discharge section converging toward one another and defining a chamber having an open first end and an open second end into which an outlet end of the motive section and an inlet end of the discharge section both extend to a position providing fluid flow around the entire outer surface of the outlet end and the inlet end, wherein the inlet end and the outlet end are spaced a lineal distance apart from one another to define a Venturi void therebetween, and divide the chamber into a first portion and a second portion in fluid communication with one another above and below the outlet end and inlet end and through the Venturi void;

a first suction housing defining a suction passageway sealingly connected to the open first end of the chamber for fluid communication therewith and with the Venturi void, a second suction housing defining a suction passageway sealingly connect to the open second end of the chamber for fluid communication therewith and with the Venturi void;

wherein the first and second suction housings and the chamber of the body collectively define a check valve chamber; and wherein the first portion and the second portion of the chamber each have a plurality of spaced apart fingers protruding radially inward and axially away from the passageway of the body from an inner wall of the chamber, which each define a seat for an open position within the check valve chamber;

a source of motive flow fluidly connected to the motive section of the Venturi device; and a first device requiring vacuum connected to the first suction passageway and/or the second suction passageway of the Venturi device.

* * * * *